US010895098B2

(12) United States Patent
Riesebosch

(10) Patent No.: US 10,895,098 B2
(45) Date of Patent: Jan. 19, 2021

(54) METHOD AND SYSTEM FOR OPENING GARAGE DOORS BY MEANS OF GEOREFERENCING

(71) Applicant: Scott Riesebosch, Welland (CA)

(72) Inventor: Scott Riesebosch, Welland (CA)

( * ) Notice: Subject to any disclaimer, the term of this patent is extended or adjusted under 35 U.S.C. 154(b) by 0 days.

(21) Appl. No.: 16/268,615

(22) Filed: Feb. 6, 2019

(65) Prior Publication Data

US 2020/0248496 A1 Aug. 6, 2020

Related U.S. Application Data

(60) Provisional application No. 62/761,509, filed on Mar. 27, 2018.

(51) Int. Cl.

| | |
|---|---|
| ***E05F 15/73*** | (2015.01) |
| ***G08C 17/02*** | (2006.01) |
| ***E05F 15/77*** | (2015.01) |
| ***G07C 9/00*** | (2020.01) |

(52) U.S. Cl.

CPC ..... *E05F 15/73* (2015.01); *E05F 15/77* (2015.01); *G07C 9/00182* (2013.01); *G08C 17/02* (2013.01); *E05Y 2900/106* (2013.01)

(58) Field of Classification Search

None

See application file for complete search history.

(56) References Cited

U.S. PATENT DOCUMENTS

| | | | | |
|---|---|---|---|---|
| 10,339,734 | B2 * | 7/2019 | Bauer | G07C 9/20 |
| 2009/0144577 | A1 * | 6/2009 | Sarker | G06F 1/3225 713/340 |
| 2012/0188054 | A1 * | 7/2012 | Bongard | G07C 9/00309 340/5.61 |

* cited by examiner

*Primary Examiner* — Daniell L Negron

(74) *Attorney, Agent, or Firm* — Erise IP, P.A.

(57) ABSTRACT

A method and system for opening garage doors is disclosed. The invention being comprised of several parts: software for mobile devices, a vehicle-dedicated, Bluetooth™ enabled beacon and a wireless door controller unit. The aforementioned software transmitting a wireless open command to said garage door controller once said beacon is within a preset range determined by said mobile device's Global Positioning System (GPS). For example, in one embodiment users place a multitude of beacons in different vehicles. As one vehicle approaches a garage, a mobile device will decipher its location and interact with the door controller. Upon entering a preset boundary, the garage door associated with said vehicle will open. An object of the invention is to enhance garage door automation.

20 Claims, 3 Drawing Sheets

METHOD AND SYSTEM FOR OPENING GARAGE DOORS BY MEANS OF GEOREFERENCING

CROSS-REFERENCE TO RELATED APPLICATIONS

This application claims the benefit of U.S. Provisional Patent Application No. 62/761,509, filed on Mar. 27, 2018.

FIELD OF THE INVENTION

The present invention generally relates to garage door openers. More specifically, it relates to a method and system for using georeferencing in conjunction with vehicle-dedicated Bluetooth™ beacons to open garage doors.

BACKGROUND

Garage door openers were invented in the United States in the mid 1900s and relied on radio frequency technology used to detonate bombs during the second world war. The first garage door openers were simple and consisted of a handheld transmitter and receiver that controlled the opener mechanism. The remote would transmit on a designated frequency and the receiver would listen for the radio signal, then open or close the garage door. As such openers gained popularity, frequency availability and interferences became problematic and DIP switch coding technology was incorporated into the systems. As digital communication technology continued to advance, the garage door industry began incorporating enhancements into remotes. United States Patent Nos. 20170084102A1 and 6476732B1 Chinese patent Nos. 104732617A and 101272304A granted to Szymke & Gramlich Stephan, Xiao and Bauman et. al. respectively disclosed bluetooth-oriented remote garage door systems compatible with mobile devices. However, these disclosures do not incorporate georeferencing capabilities. International patent No. 2015023737A1, U.S. Pat. No. 9,057,210B2 granted to Dumas et. al. and Myers et. al. respectively also disclosed bluetooth-oriented garage door opening systems with GPS capabilities. However, these disclosures do not incorporate georeferencing combined with mobile devices and separate, vehicle-dedicated, security beacons.

SUMMARY OF THE INVENTION

The device herein disclosed and described provides a solution to the shortcomings in the prior art through the disclosure of a method and system for opening garage doors by means of georeferencing and vehicle-dedicated, Bluetooth™ beacons or onboard vehicle communications systems. An object of the invention is to allow a user to open a garage door by driving a vehicle within proximity to the door. A driver uses a mobile application on their smartphone that automatically recognizes and interacts with a beacon stored in the vehicle, or the onboard vehicle communications system. The beacon and vehicle location are determined in real-time using the smartphone's GPS or the onboard vehicle GPS. Once within range of the door, a signal is sent from the mobile device to the corresponding garage door controller which in turn sends an 'open' signal to the garage door opener causing it to open.

Another object of this invention is to provide a means to customize the boundary range. For example, users in rural areas can preset a garage door to open when a vehicle arrives in a driveway that is 100 feet radius from the door. Users in urban areas can preset a garage door range at a much closer range depending on residential density. Such settings are available on the smartphone application software.

Another object of this invention is to provide a means to allow different doors to open on multiple car garage doors depending on which vehicle is within proximity. For example, one member of a residence places a beacon with a unique transmission code into one car that is stored on one side of a two-car garage. Another member places another beacon with a unique code into another vehicle. When each member arrives within proximity to the garage, a door associated with each side of the garage will be opened by a command sent from the smartphone application depending on the beacon or onboard vehicle communications system detected by the smartphone application.

Another object of this invention is to provide a means to conserve mobile device power while using the software application. Conventional GPS applications are energy intensive and can drain a mobile device's battery quickly. The invention's software has a unique power-saver mode that allows a device's GPS to run in a lower power mode, reducing power drain on the battery when the user is far enough away from their garage that high accuracy GPS is not required.

Another object of this invention is to provide a means to utilize the vehicle's onboard GPS to receive location information rather than the GPS within the Smartphone, further reducing power drain on the smartphone battery.

Another object of this invention is to provide a means to customize how quickly a garage door will open when triggered and how long it stays open. Users who live in high-crime area may feel more comfortable with a door that closes quickly as compared to a user in an isolate rural area who may prefer to keep the door open longer to access the garage thereafter.

Another object of this invention is to provide a means to customize how high a garage door will open when triggered. Some users who own a low-sling sports car may prefer to have the door open at a shorter height than those who own a sports utility vehicle. Additionally, the garage door may only need to be opened partially to allow a courier arriving to slide a package into the garage.

It is briefly noted that upon reading this disclosure, those skilled in the art will recognize various means for carrying out these intended features of the invention. As such it is to be understood that other methods, applications and systems adapted to the task may be configured to carry out these features and are therefore considered to be within the scope and intent of the present invention, and are anticipated. With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilised as a basis for designing of other structures, methods and systems for carrying out the several purposes of the present disclosed device. It is important, therefore, that the claims be regarded as including such equivalent construction and methodology insofar as they do not depart from the spirit and scope of the present invention. As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

The objects features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF THE FIGURES

The accompanying drawings, which are incorporated herein and form a part of the specification, illustrate some, but not the only or exclusive, examples of embodiments and/or features.

Figure 1:
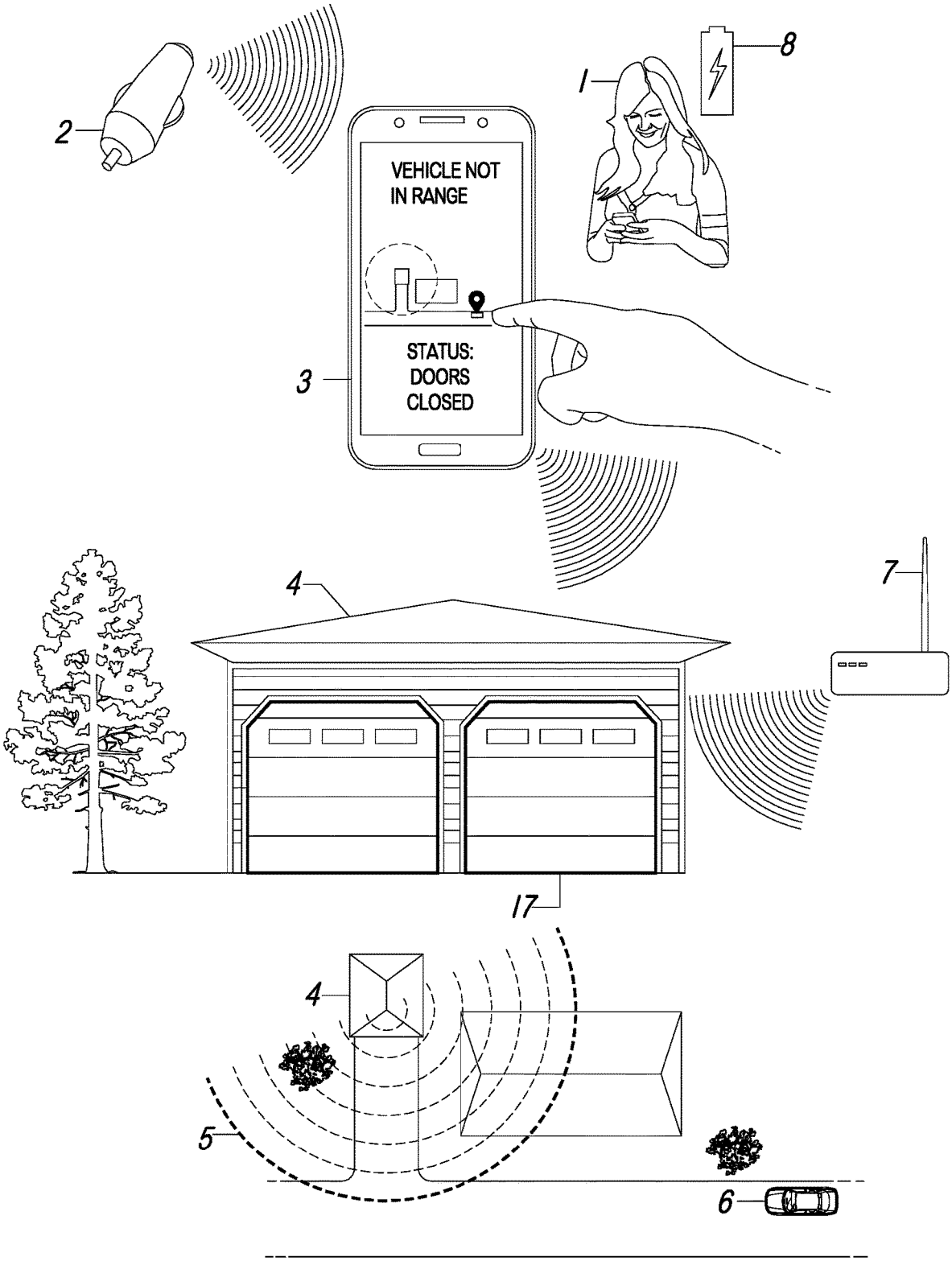
FIG. 1 shows a perspective view of the invention with vehicle out of range.

Other aspects of the present invention shall be more readily understood when considered in conjunction with the accompanying drawings, and the following detailed description, neither of which should be considered limiting.

DETAILED DESCRIPTION OF FIGURES

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

FIG. 1 shows a perspective view of the invention with a user vehicle 6 located out of predetermined range boundary 5. Said boundary being part if an apparatus having several parts. One part being mobile device application 3 comprised of software such as but not limited to: Java™ C++™, etc and compatible with, but not limited to: Android™, Windows™, Apple™ etc. An embodiment of the invention may also include a subscription for members therein. Said application 3 being able to utilize the device's GPS function or the GPS system of the vehicle and recognize vehicle-dedicated beacon 2 by means of, but not limited to: Bluetooth™ signals and the like. Said mobile device tracking the location of said beacon 2 in real time. The aforementioned beacon 2 comprised of a cylindrical case with battery power and transmitter. An embodiment of beacon 2 also having an adapter on a distal end to receive a power connection from a vehicle cigarette lighter. Another embodiment of beacon 2 also being a permanently installed Bluetooth enabled device such as the vehicle communications and infotainment system. The application software also having user settings allowing a user to predetermine said range boundary 5 and associate a beacon 2 with an individual garage door so that once user vehicle 6 enters said range, the mobile device application 3 sending a wireless command to garage door controller 7. Controller 7 comprised of a wireless receiver with antenna receiving secure transmissions from said mobile device. Said controller 7 also having an onboard transmitter sending open and close signals to an existing garage door opener through either wireless or wired communication, said controller 7 may be external or internal to the garage door opener. FIG. 1 also showing garage door 17 closed when user vehicle 6 not within said range boundary 5 as well as battery saver mode application symbol 8 in use when said vehicle 6 is not within range.

Figure 2:
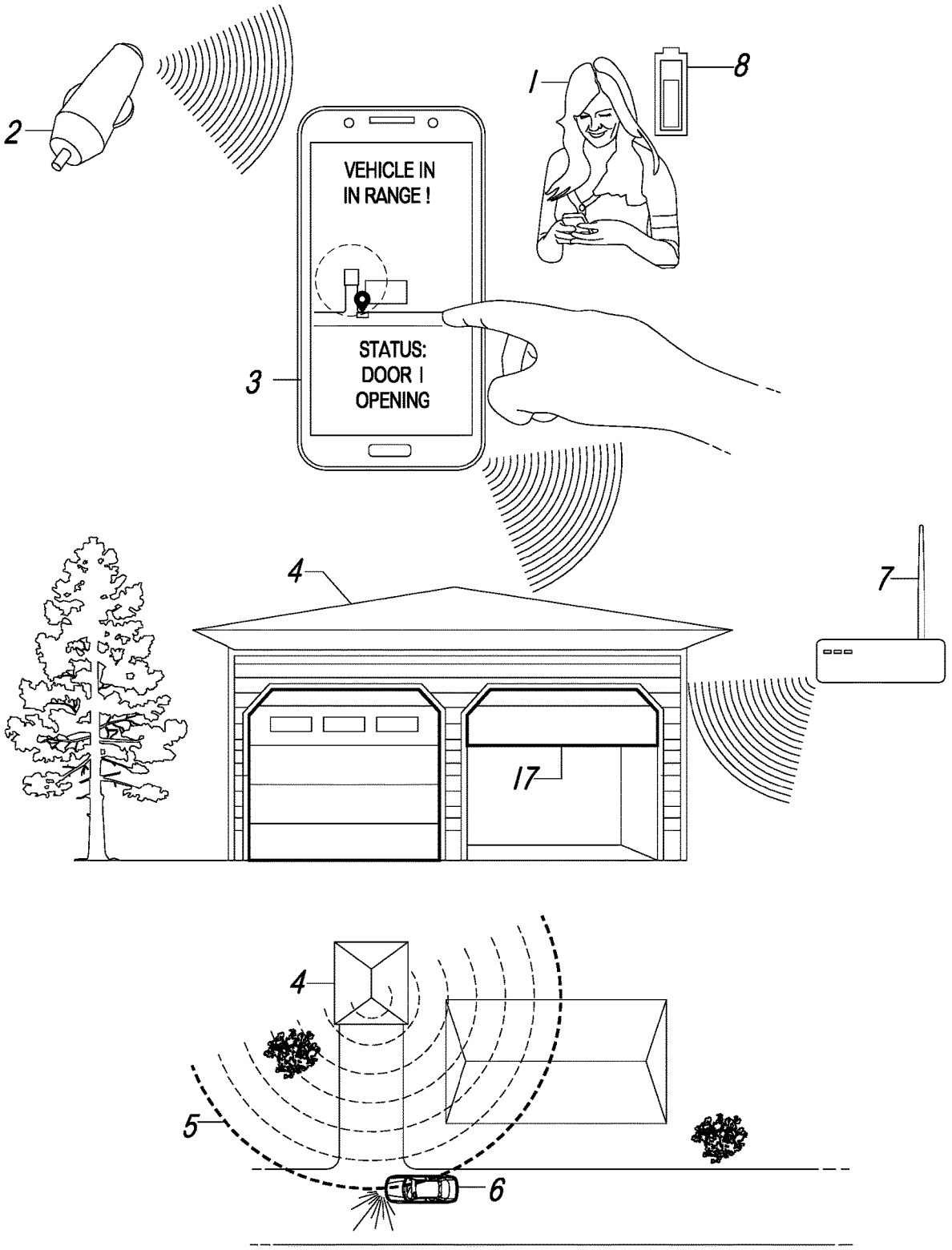
FIG. 2 shows a perspective view of the invention with vehicle in range.

FIG. 2 shows a perspective view of the invention with vehicle 6 breaching said range boundary 5 triggering the mobile device application 3 to interact with door controller 7 which in turn sending an open command to garage door 17. The figure also showing user vehicle 6 within mobile device application 3's display screen for user 1.

Figure 3:
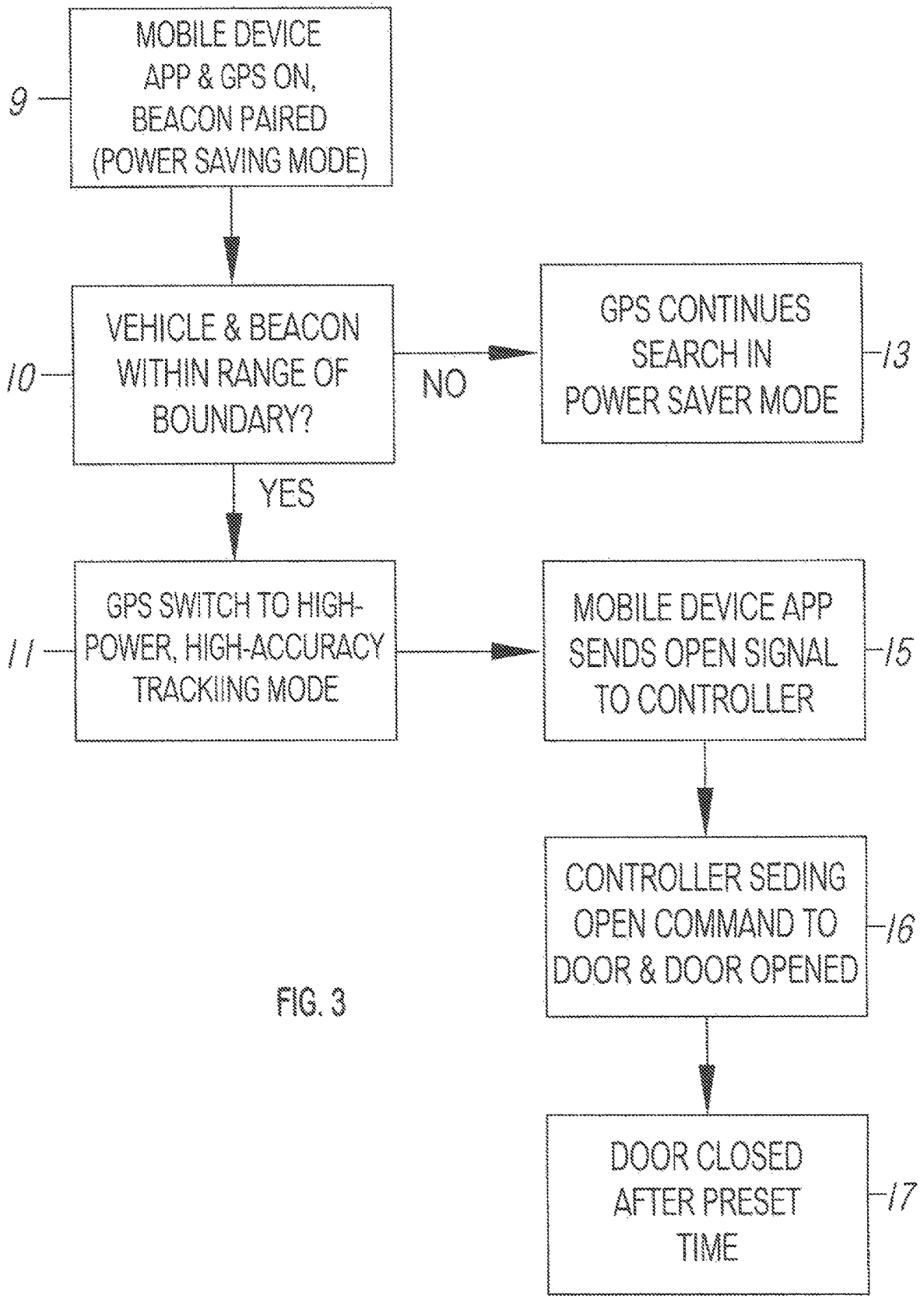
FIG. 3 shows a flow diagram of the invention method.

FIG. 3 shows a flow diagram of the invention method with said mobile application installed and configured with GPS always operating in power saving mode—regardless if a user directly interacts with (or does not interact with) said application in stage 9. In stage 10 said software application (in conjunction with GPS) determining if a Bluetooth™ paired beacon inside a vehicle are within the aforementioned boundary range of a garage. Said boundary range being preset by a user with a default value of, but not limited to, four kilometers. If not in range; garage doors remaining closed, GPS remaining in power saver mode and continuing search for said beacon and vehicle in stage 13. If beacon and vehicle being found by said GPS within said boundary range, GPS switching to higher-resolution and using more mobile device power tracking in stage 11. The aforementioned resolution switching in stage 11 may have a second, dedicated, preset range boundary (separate from the first) called a 'switching boundary' allowing time for said switching to take place on a mobile device before a user reaches a garage. Said switching being conducted by various means depending on mobile device operating system is being used. An Apple™ device having a switching boundary range between, but not limited to: between 500 m and one kilometer. An Android™ device having switching based on automatic location update requests by the mobile application to said operating system at increasing intervals. If said vehicle and beacon within the aforementioned garage boundary range, mobile application signaling door controller in stage 15 and then controller sending open command to existing garage door opener allowing garage door to open for vehicle in stage 16. After a predetermined time (set by the application) said door being closed in stage 17 and application returning to power saver mode.

It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner. While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention.

What is claimed is:

1. A system for opening a garage door configured to be opened and shut by an operatively-connected garage door opener, the system comprising:

a transmitter having a unique identifier, the transmitter being either: (i) configured for incorporation into and dedication to a vehicle, or (ii) already existing in the vehicle;

the transmitter configured to continually transmit enabling real-time tracking;

an application installable onto a mobile wireless device, the application configured to recognize the transmitter and the identifier, the application further configured to access a GPS source and determine whether the vehicle has entered into a geofence boundary; and a controller configured to receive an open command from the mobile wireless device when the application determines the geofence boundary has been entered met, and the application then transmitting an open signal to the garage door system opener to open the garage door.

2. The system of claim 1 wherein the application is configured to allow the automatic instruction to open the garage door upon a recognition of the unique identifier of the transmitter.

3. The system of claim 1 wherein the transmitter is either included in a vehicle infotainment system or a BlueTooth™ beacon.

4. The system of claim 1 wherein the source of GPS is in the mobile device.

5. The system of claim 1 wherein the source of GPS is associated with a vehicle system.

6. The system of claim 1 wherein the unique identifier of the transmitter is one of a MAC address or a universally unique identifier.

7. The system of claim 1 wherein the boundary condition is related to a distance from the controller and is configurable by a user to change the geofence boundary.

8. The system of claim 1 wherein the application, depending on a detected GPS position, places the mobile device into a low-power mode.

9. The system of claim 1 wherein the application is configured to optionally utilize the vehicle GPS system.

10. The system of claim 1 wherein the application further comprises:

a door-close process included in the application, the door-close process being configured to transmit a close signal to cause the garage door when the application has detected an exit out of the geofence boundary to cause the door to close.

11. The system of claim 10 wherein the application comprises:

a duration-setting process, the duration-setting process enabling a user to modify an amount of time the door is open after the door-open signal is transmitted.

12. The system of claim 1 wherein the application comprises:

a height-control process enabling a user to select a height to which the door will open.

13. The system of claim 1 wherein the application comprises:

a door-speed-control process enabling a user to select a speed at which the door will open or close.

14. A method for opening a door, the method comprising:

providing an application for installation onto a user's hand-held mobile device;

providing a transmitter to be included in, travel with, and remain within a vehicle, the transmitter emitting a signal indicating a unique identifier associated with the transmitter, the transmitter being configured to continually transmit enabling realtime tracking;

configuring the application to recognize the identifier;

incorporating a door-activation process into the application, the door-activation process using one of a system on the mobile device or a system of the vehicle to continually monitor a location, the door-activation process then causing the transmission of an open signal to a door opener system upon detection that both: (i) the location is at or within a proximity relative to the door, and (ii) confirmation that the unique identifier associated with the transmitter has been received by the hand-held mobile device.

15. The method of claim 14 comprising:

providing a BlueTooth™ compatible beacon to serve as the transmitter.

16. The method of claim 14 the application comprising:

using a GPS system for continually monitoring the location, the GPS system being incorporated into one of the mobile device or the vehicle.

17. The method of claim 14 the application comprising:

placing the mobile device into a low-power mode depending on the location detected.

18. The method of claim 14 the application comprising:

transmitting a close signal at a duration of time after the application has caused the transmission of the open signal.

19. The method of claim 14 wherein the application enables:

a user setting the duration of time between opening and closing; and a user selecting a speed at which the door will open or close.

20. A system comprising:

an application installable onto a mobile wireless device, the application configured to recognize a vehicle-dedicated transmitter, the transmitter having a unique identifier and being associated by the application with the transmitter, the transmitter being configured to continually transmit enabling real-time tracking, the application further configured to access a GPS source and determine a location of the vehicle relative to a boundary condition determined based on a distance from a controller; and the controller configured to: (i) receive open and close signals from the mobile wireless device when the application determines the boundary condition has been met, and (ii) send a signal to operate a garage door opener to open a garage door.

* * * * *